US006130683A

United States Patent [19]

Ju

[11] Patent Number: 6,130,683

[45] Date of Patent: Oct. 10, 2000

[54] RECORDING HEAD DRIVING DETECTION CIRCUIT OF AN INK-JET RECORDING APPARATUS

[75] Inventor: Young-Bok Ju, Kyungki-do, Rep. of Korea

[73] Assignee: SamSung Electronics Co., Ltd., Suwon, Rep. of Korea

[21] Appl. No.: 08/781,977

[22] Filed: Dec. 27, 1996

[30] Foreign Application Priority Data

Dec. 27, 1995 [KR] Rep. of Korea ..... 95-59429

[51] Int. Cl.[7] ..... B41J 29/393

[52] U.S. Cl. ..... 347/19

[58] Field of Search ..... 347/14, 19, 10, 347/17, 57, 12, 67, 49, 50, 23

[56] References Cited

U.S. PATENT DOCUMENTS

| | | | |
|---|---|---|---|
| 4,499,475 | 2/1985 | Jinnai | 234/19 |
| 4,996,487 | 2/1991 | McSparran et al. . | |
| 5,126,754 | 6/1992 | Spinar et al. | 347/14 |
| 5,319,389 | 6/1994 | Ikeda et al. . | |
| 5,418,558 | 5/1995 | Hock et al. | 347/19 |
| 5,563,634 | 10/1996 | Fujii et al. . | |
| 5,638,097 | 6/1997 | Takayanagi et al. . | |
| 5,644,341 | 7/1997 | Fujii et al. . | |
| 5,673,071 | 9/1997 | Fuse . | |
| 5,757,394 | 5/1998 | Gibson et al. . | |

FOREIGN PATENT DOCUMENTS

| | | | |
|---|---|---|---|
| 60 104 338 | 8/1985 | Japan | 347/19 |

*Primary Examiner*—John Barlow
*Assistant Examiner*—Charles W. Stewart, Jr.
*Attorney, Agent, or Firm*—Robert E. Bushnell, Esq.

[57] ABSTRACT

An ink jet recording apparatus includes a recording head have heating elements respectively installed in nozzles of the recording head for heating the ink so as to eject the ink within corresponding nozzles; a driver for driving the heating elements in correspondence with received nozzle driving data; an interrupter having a voltage detector and pulse generator for generating an interrupt pulse in response to the driving of at least one of the heating elements; and a controller for outputting the nozzle driving data corresponding to image data to be recorded to the driver unit and for detecting whether or not the recording head has been driven in accordance with the input of the interrupt pulse.

6 Claims, 4 Drawing Sheets

RECORDING HEAD DRIVING DETECTION CIRCUIT OF AN INK-JET RECORDING APPARATUS

CLAIM OF PRIORITY

This application makes claims all benefits accruing under 35 U.S.C. §119 from an application for RECORDING HEAD DRIVING DETECTION CIRCUIT OF AN INK JET RECORDING APPARATUS earlier filed in the Korean Industrial Property Office on Dec. 27, 1995 and there duly assigned Serial No. 59429/1995.

BACKGROUND OF THE INVENTION

1. Field of the Invention

The present invention relates to an ink-jet recording apparatus for recording an image by ejecting ink within an ink cartridge onto a recording medium via nozzles of a recording head, and more particularly to a circuit for detecting whether or not a recording head is being driven.

2. Description of the Related Art

In recording an image on a recording medium such as a sheet of paper or an overhead projection film, recording systems such as a wire dot system, a thermal transfer system and an ink jet system generally utilize their own recording heads. Among the above-stated recording systems, the ink jet system is for recording an image by directly ejecting ink onto a recording medium. A recording apparatus employing the ink jet system has a recording head arranged with a plurality of nozzles formed with minute ejection holes for ejecting the ink. The ink within the nozzles is heated by heating elements installed in respective nozzles, thereby expanding the ink so as to be ejected out of the nozzles. By this operation, the heating elements are selectively driven to record a desired image onto the recording medium.

If a circuit for driving the heating elements breaks down, the ink within a corresponding nozzle or nozzles is not ejected to thereby impede the recording of an image or to degrade the picture quality. In this case, earlier systems have heretofore detected the failure in the driving of the recording head and informed a user of the detection, thereby causing the user to replace the recording head. For this operation, an ink jet recording apparatus is provided with a recording head driving detection circuit as shown in FIG. 1 to detect whether or not the recording head is being driven. In FIG. 1, a plurality of heating elements RT1~RTn are installed to respectively correspond to nozzles (not shown) of the recording head, and heat the ink so as to eject the ink within the corresponding nozzles when being driven by a driving means 2. The driving means 2 includes a plurality of resistors RB1~RBn, a plurality of transistors Q1~Qn and a driving circuit 8 for driving the heating elements RT1~RTn in correspondence with nozzle driving data ND supplied from a processor 6. Resistors RB1~RBn are respectively connected between a driving power source voltage Vpp and one respective end of each of the heating elements RT1~RTn, and transistors Q1~Qn are respectively connected between the other respective ends of the heating elements RT1~RTn and ground. Driving circuit 8 is connected between respective bases of transistors Q1~Qn and the processor 6. Transistors Q1~Qn supply the driving power source voltage Vpp to corresponding heating elements among the heating elements RT1~RTn in accordance with a signal supplied to respective bases from the driving circuit 8, thereby driving corresponding nozzles. A driving detecting circuit 4 is formed by a plurality of diodes D1~Dn, a Zener diode ZD1, two resistors R1 and R2, a transistor Qa and a D flip-flop 10. Processor 6 drives heating elements RT1~RTn via the driving means 2, and detects whether the recording head is driven or not based upon a logic level of a detection signal DET from the D flip-flop 10 of driving detecting circuit 4, and supplies a clear signal $\overline{\text{CLR}}$ to the D flip-flop 10 to clear it.

An operation of the recording head driving detection circuit as shown in FIG. 1 will be described with reference to FIG. 2 showing operational timing charts of respective parts shown in FIG. 1 and FIG. 3 showing the flowchart of the operation of the processor 6.

First, at the point prior to enabling nozzle driving data ND, transistors Q1~Qn are in the turned off state and, accordingly, diodes D1~Dn are in the turned off state. Therefore, a voltage Va at a junction point of diodes D1~Dn and Zener diode ZD1 goes to a high level as shown in FIG. 2. Thus, transistor Qa is in the turned on state and an output voltage Vb of a collector of transistor Qa is supplied to a clock terminal of D flip-flop 10 at a low level as shown in FIG. 2. At this time, D flip-flop 10 is cleared by a clear signal $\overline{\text{CLR}}$ of the processor 6 after initialization or previous recording head driving, and maintains the stand-by state.

Under the above-described state, the processor 6 generates nozzle driving data ND corresponding to image data to be recorded and provides it to the driving means 2 in step 300, and checks the logic level of the detection signal DET received via the detecting circuit 4 in step 302. Here, it is assumed that nozzle driving data ND is enabled from a point to during an interval Te as shown in FIG. 2. Driving circuit 8 drives heating elements RT1~RTn to correspond to nozzle driving data ND for enable interval Te. That is, transistors Q1~Qn are selectively turned on in accordance with nozzle driving data ND to force the driving power source voltage Vpp to be applied to corresponding heating elements. By doing so, corresponding heating elements are heated, which in turn heats the ink within the corresponding nozzles to enable ejection. Among diodes D1~Dn, diodes connected to transistors via the heating elements are turned on at this time. By this operation, the level of voltage Va at the junction point of diodes D1~Dn and Zener diode ZD1 becomes low at point to as shown in FIG. 2. Then, transistor Qa is turned off to permit the output voltage Vb of the collector of transistor Qa to transit from the low to the high at point to as shown in FIG. 2, thereby being supplied to D flip-flop 10 as a clock. The D flip-flop 10 latches a high of a power source voltage Vcc at the rising edge of voltage Vb to provide a detection signal DET to point to of FIG. 2 at the high level. Here, if any of the heating elements RT1~RTn or transistors Q1~Qn for driving heating elements RT1~RTn and driving circuit 8 are broken, the detection signal DET continuously maintains the low level.

Thus, the processor 6 generates nozzle driving data ND in step 300, and checks the logic level of detection signal DET in step 302, so that the driving of heating elements RT1~RTn, i.e., the recording head, can be detected. If detection signal DET is at a low level, it means that it has been determined that the recording head is not being driven so that it is necessary to execute error processing. The error processing is performed to inform the user of the failure in such a manner that the operation is stopped to display a message indicating the failure of the recording head. When the detection signal DET of a high level is received at point to, it means that the recording head is being driven. After this, a low clear signal $\overline{CLR}$ having a prescribed pulsewidth is provided to D flip-flop 10 at point t1 as shown in FIG. 2, thereby clearing the D flip-flop 10 in step 304.

The above-described operation is repeatedly carried out whenever the recording head is driven to continuously detect whether or not the recording head is being driven.

The processor 6 checks whether or not the recording head is driven by means of detection signal DET whenever the recording head is driven to clear the D flip-flop 10 by the clear signal $\overline{CLR}$ so that the processing time and load required for detecting the driving of the recording head are greatly increased.

Consequently, there is heretofore a drawback in that the increased processing time and load required for detecting the driving of the recording head as described above slows down performance, i.e., the printing speed.

Meantime, an ink jet recording apparatus utilizing a recording head of the disposable type tends to be gradually accepted for general use. In the disposable type of head, the recording head is integrally provided with an ink cartridge to be disposed altogether when the ink within the ink cartridge is thoroughly consumed. Frequently, in replacing the recording head, the ink jet recording apparatus is often operated while a user has not yet mounted a new recording head by mistake after removing the used recording head. Thus, the recording operation is performed in spite of a lack of a recording head. For this reason, a detection pin is separately installed on the ink cartridge or recording head for detecting the existence of the recording head in the corresponding apparatus, and the detection pin is utilized to detect whether or not the recording head has been mounted. However, it is disadvantageous in that the detection pin must be separately installed and additionally requires a line for connecting to the ink cartridge or recording head, and the number of pins of a connector is increased.

SUMMARY OF THE INVENTION

Therefore, it is an object of the present invention to provide a recording head driving detection circuit capable of shortening the processing time required for detecting whether or not a recording head is being driven and decreasing a load imposed.

It is another object of the present invention to provide a recording head driving detection circuit capable of simultaneously detecting whether or not a recording head is being driven and whether or not the recording head has been mounted without employing a separate detection element.

To achieve the above object of the present invention, a recording head driving detection circuit of an ink jet recording apparatus includes: a plurality of heating elements respectively installed in nozzles provided in the recording head for heating the ink so as to eject the ink within corresponding nozzles; a driver for driving the heating elements in correspondence with received nozzle driving data, and an interrupter for generating an interrupt pulse in response to the driving of at least one of the heating elements. Also, a controller generates nozzle driving data corresponding to image data to be recorded to the driver, and detects whether or not the recording head is being driven in accordance with the input of the interrupt pulse. Also, the controller detects whether or not the recording head has been mounted by the input of the interrupt pulse after generating the nozzle driving data to outputted to the driver.

BRIEF DESCRIPTION OF THE DRAWINGS

A more complete appreciation of this invention, and many of the attendant advantages thereof, will be readily apparent as the same becomes better understood by reference to the following detailed description when considered in conjunction with the accompanying drawings, in which like reference symbols indicate the same or similar components, wherein.

DETAILED DESCRIPTION OF THE PREFERRED EMBODIMENT

Figure 1:
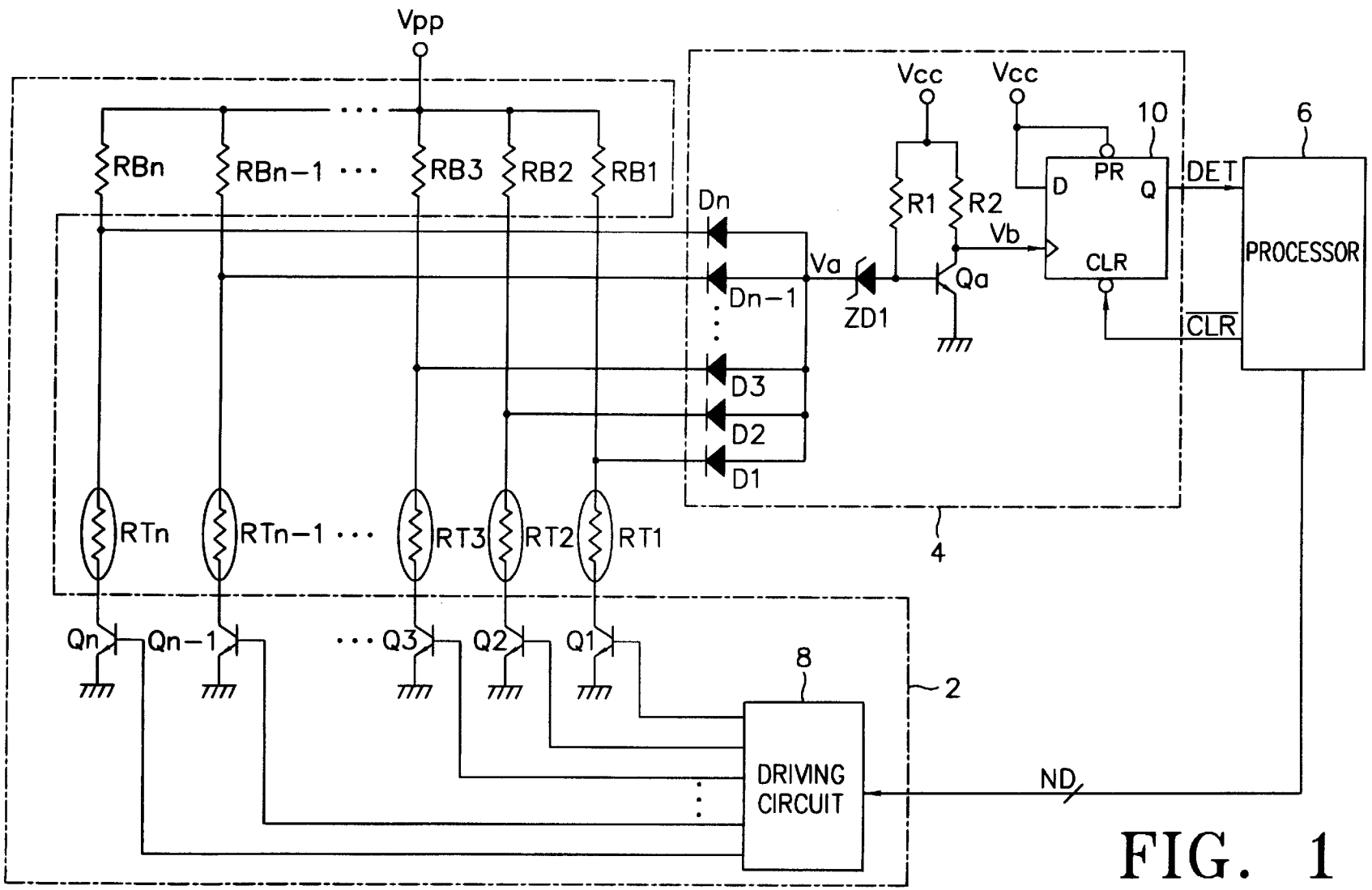
FIG. 1 is a view showing an earlier recording head driving detection circuit.
Figure 2:
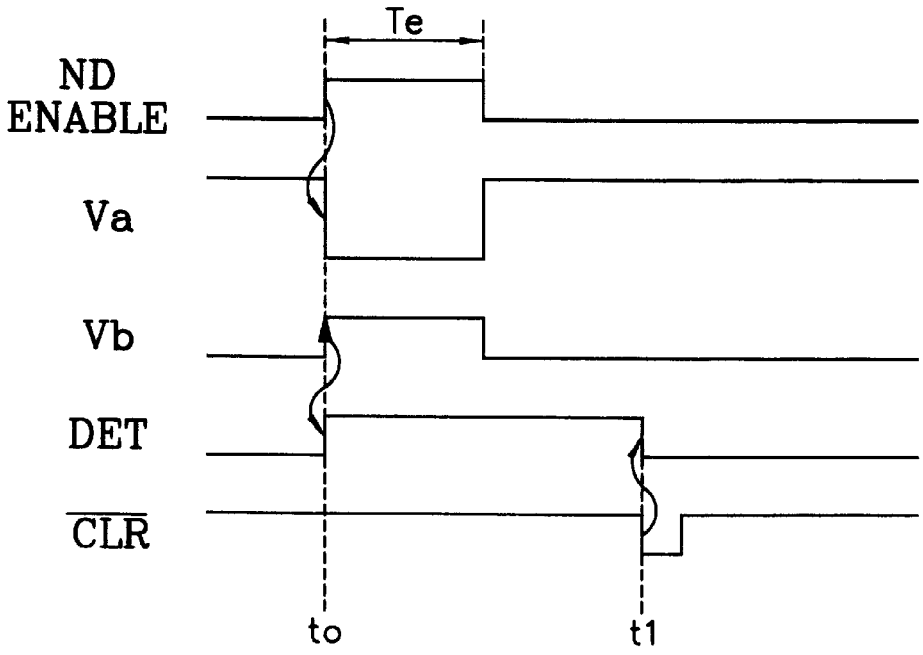
FIG. 2 are operational timing charts of respective parts shown in FIG. 1.
Figure 3:
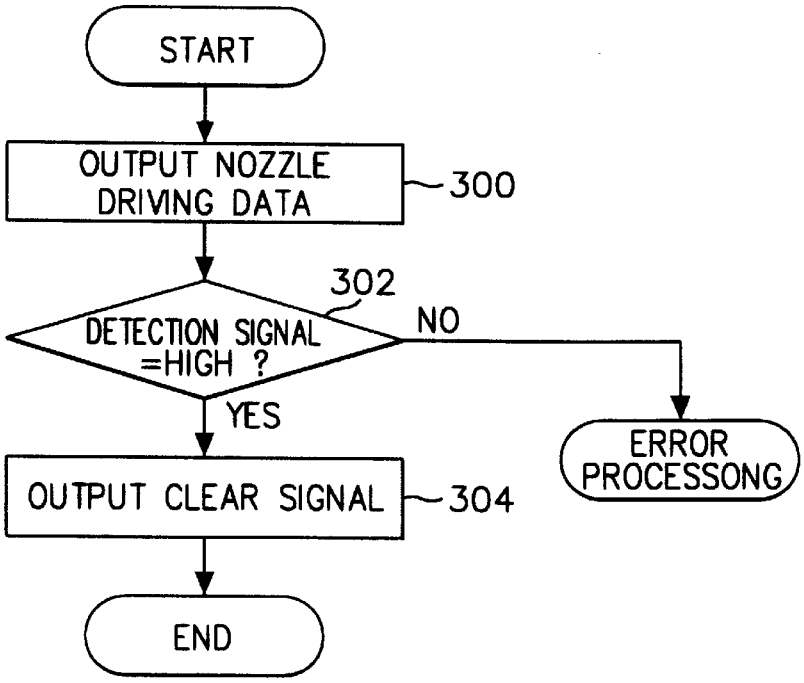
FIG. 3 is a flowchart showing the operation of the circuit of FIG. 1.

A preferred embodiment of a recording head driving detection circuit according to the present invention will be described in detail with reference to accompanying drawings. Here, it should be noted that like parts are designated by the same reference numerals everywhere, if possible. Also, specific details such as a circuit construction, elements, flow of processing and logic status are provided for assisting an overall understanding of the present invention. It is obvious to one of ordinary skill in the art that the present invention can be embodied without involving the specific details.

Figure 4:
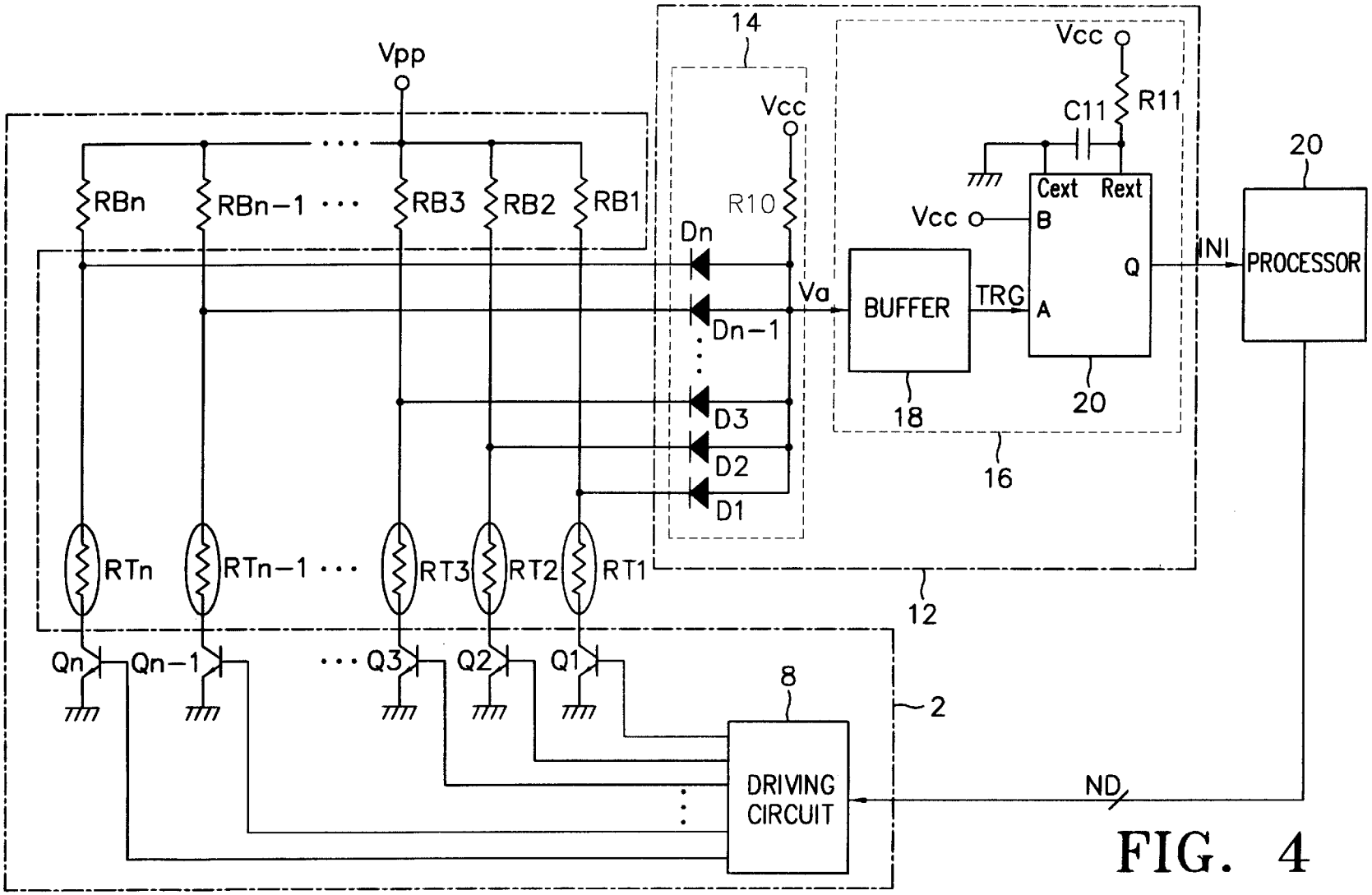
FIG. 4 is a view showing a recording head driving detection circuit according to the present invention.

FIG. 4 illustrates a diagram of the recording head driving detection circuit according to the present invention, in which heating elements RT1~RTn and the driving means 2 are identical to those described with reference to FIG. 1. An interrupter circuit 12 is provided in place of detecting circuit 4 of FIG. 1, and a processor 20 performs an operation in accordance with the flowchart shown in FIG. 6.

The interrupter circuit 12 is formed by a voltage detecting circuit 14 and a pulse generating circuit 16, and produces an interrupt pulse INI in response to the driving of at least one heating element among the heating elements RT1~RTn. The voltage detecting circuit 14 is constructed such that the cathodes of a plurality of diodes D1~Dn are respectively connected to corresponding junction points of resistors RB1~RBn and heating elements RT1~RTn, and the anodes are commonly connected to a power source voltage Vcc via a resistor RIO, and generates a detection voltage Va having different levels in accordance with the driving of heating elements RT1~RTn. The pulse generating circuit 16 connects an input of a buffer 18 to the junction point of the cathodes of diodes D1~Dn and resistor R10, and an input A of a monostable multivibrator (hereinafter simply referred to as "MMV") 20 is connected to an output of the buffer 18. Another input B of MMV 20 is connected to power source voltage Vcc, and a resistor R11 is connected to an input Rext of MMV 20 while being connected to an input Cext of MMV 20 which is connected to ground via a capacitor C11. The buffer 18 buffers the detection voltage Va to generate a trigger signal TRG, and MMV 20 is triggered at a falling edge of trigger signal TRG supplied from the buffer 18 to generate a pulse of a high level having a prescribed width as interrupt pulse INI. The pulsewidth of the interrupt pulse INI is determined by the resistor R11 and capacitor C11.

The processor 20 produces nozzle driving data ND corresponding to image data to be recorded to supply it to driving means 2, and then detects whether or not the recording head is driven by the input of the interrupt pulse INI.

Figure 5:
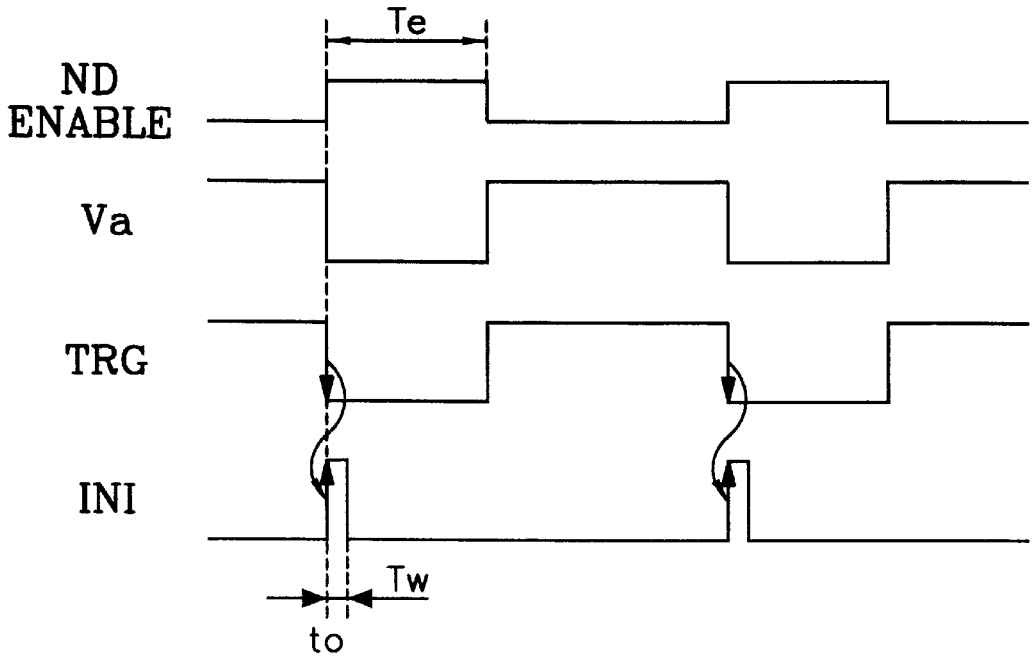
FIG. 5 are operational timing charts of respective parts shown in FIG. 4.
Figure 6:
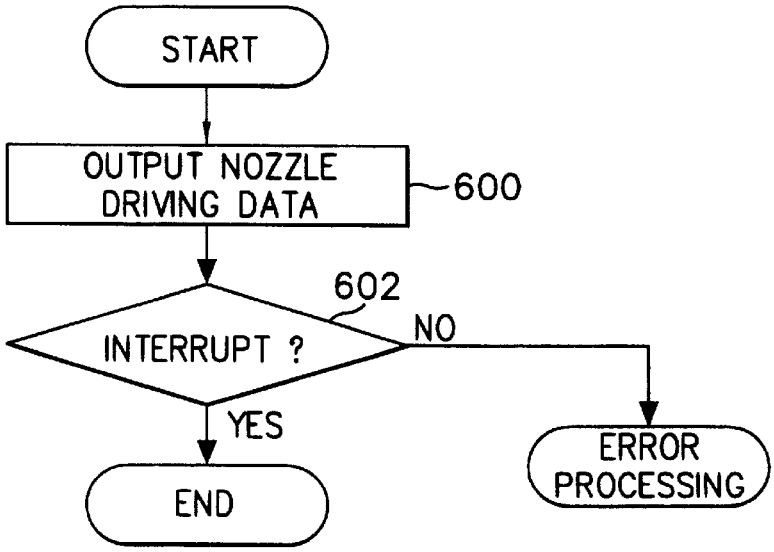
FIG. 6 is a flowchart showing the operation of the processor of the detection circuit according to the present invention.

FIG. 5 are operational timing charts of respective parts shown in FIG. 4, and FIG. 6 is a flowchart showing the operation of the processor 20 of the detection circuit for detecting the driving of recording head according to the present invention.

An operation of the present invention will be described in detail with reference to FIGS. 4, 5 and 6.

To begin with, all transistors Q1~Qn are in the turned off state at a point prior to enabling nozzle driving data ND, and diodes D1~Dn are thus in their turned off state. Therefore, voltage Va at the junction point of diodes D1~Dn and resistor RIO goes to the high level as shown in FIG. 5 with the consequence of allowing the output of buffer 18 to have a high level and the output of MMV 20 to maintain a low level.

Under the above-described state, processor 20 generates nozzle driving data ND corresponding to the image data to be recorded to and supplies it to the driving means 2 in step 600, and waits for the input of interrupt pulse INI of a high level from the interrupt circuit 12. It is assumed that nozzle driving data ND is enabled from point to during an enabled portion Te. The driving circuit 8 drives the heating elements RT1~RTn corresponding to nozzle driving data ND during the enabled portion Te. In other words, transistors Q1~Qn are selectively turned on in accordance with nozzle driving data ND to supply driving power source voltage Vpp to corresponding heating elements. By doing so, corresponding heating elements are heated to heat the ink within the corresponding nozzles so as to eject the ink. Among diodes D1~Dn, the diodes connected to the turned-on transistors via the heating elements are turned on. Thus, the level of voltage Va at the junction point of diodes D1~Dn and resistor R10 goes to a low level at point to as shown in FIG. 5. By this transition, trigger signal TRG being the output of buffer 18 is transited from a high to a low level at point to as shown in FIG. 5, thereby being supplied to input A of MMV 20. Then, MMV 20 is triggered by the falling edge of trigger signal TRG to generate interrupt pulse INI which has the high level during a predetermined width Tw as shown in FIG. 5. At this time, if any of the heating elements RT1~RTn or transistors Q1~Qn and driving circuit 8 for driving heating elements RT1~RTn are broken, the low-level signal is continuously provided from MMV 20 without supplying the interrupt pulse INI.

Due to this operation, after processor 20 generates nozzle driving data ND to provide the result in step 600, a determination is made as to whether or not the heating elements RT1~RTn, i.e., the recording head, are driven in accordance with the input of the interrupt pulse INI in step 602. When the interrupt pulse INI of a high level is not received, it is presumed that the recording head is not being driven so as to cause an error processing. When the interrupt pulse INI is received at point to as shown in FIG. 5, it is presumed that the recording head is being driven.

The above-described operation is repeatedly carried out whenever the recording head is driven to allow for continuously detecting whether or not the recording head is being driven.

The driving of the recording head has been checked by processor 6 by detection signal DET whenever the recording head is driven to clear the D flip-flop 10 by means of the clear signal $\overline{CLR}$ according to the earlier technique, but the driving of the recording head is checked only by the interrupt according to the present invention to decrease the time required for detecting the driving of the recording head and the load.

On the other hand, in case of an ink jet recording apparatus using a recording head of the disposable type, the foregoing operation is performed whenever the initialization operation of the ink jet recording apparatus is executed to detect whether or not the recording head has been mounted. In other words, after processor 20 generates nozzle driving data ND per the initialization operation of the ink jet recording apparatus, it is determined that the recording head has been mounted by the input of the interrupt pulse INI; if not, it is determined that the recording head has not been mounted.

Therefore, not only the driving of the recording head but also the mounting of the recording head is detected without using a separate detecting element.

According to the present invention as described as above, the processing time required for detecting the driving of the recording head is shortened and the load is decreased to be effective in improving the performance of the ink jet recording apparatus. Also, the mounting of the recording head is detected without employing a separate detecting element.

It should be understood that the present invention is not limited to the particular embodiment disclosed herein as the best mode contemplated for carrying out the present invention, but rather that the present invention is not limited to the specific embodiments described in this specification except as defined in the appended claims.

What is claimed is:

1. An ink jet recording apparatus comprising:

a recording head having a plurality of heating elements respectively installed in nozzles provided in the recording head for heating the ink so as to eject the ink within corresponding nozzles;

a driver for driving said heating elements in correspondence with received nozzle driving data;

an interrupter for generating an interrupt pulse in response to the driving of at least one of said heating elements by said driver; and a controller for outputting said nozzle driving data corresponding to image data to be recorded to said driver, and for detecting whether or not said recording head has been driven in accordance with the input of said interrupt pulse.

2. The ink jet recording apparatus as claimed in claim 1, wherein said interrupter comprises:

a voltage detector connected between said heating elements and a power source voltage for generating a detection voltage of different levels in accordance with the driving of said heating elements; and a pulse generator for generating said interrupt pulse having a prescribed width by being triggered when the detection voltage goes to a preset level.

3. The ink jet recording apparatus as claimed in claim 2, wherein said controller detects that said recording head is normally driven when receiving said interrupt pulse after generating said nozzle driving data.

4. The ink jet recording apparatus as claimed in claim 3, wherein said controller detects that said recording head is not being driven by an absence of said interrupt pulse being supplied after generating said nozzle driving data.

5. The ink jet recording apparatus as claimed in claim 4, wherein said controller detects that said recording head has been mounted when said interrupt pulse is generated after generating said nozzle driving data whenever an initialization operation of said ink jet recording apparatus has been executed.

6. The ink jet recording apparatus as claimed in claim 5, said controller determining that said recording head has not been mounted by detecting the absence of said interrupt pulse being supplied after generating said nozzle driving data whenever said initialization operation of said ink jet recording apparatus has been executed.

* * * * *